US011236584B2

(12) United States Patent
Zhang et al.

(10) Patent No.: US 11,236,584 B2
(45) Date of Patent: Feb. 1, 2022

(54) METHOD FOR CONTINUOUS DOWNHOLE COOLING OF HIGH-TEMPERATURE DRILLING FLUID

(71) Applicant: SOUTHWEST PETROLEUM UNIVERSITY, Chengdu (CN)

(72) Inventors: Jie Zhang, Chengdu (CN); Xin Li, Chengdu (CN); Cuinan Li, Chengdu (CN); Zaipeng Zhao, Chengdu (CN); Weilin Chen, Chengdu (CN); Jingbin He, Chengdu (CN); Peigang Wang, Chengdu (CN); Xuefeng Sun, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 17/123,123

(22) Filed: Dec. 16, 2020

(65) Prior Publication Data

US 2021/0102441 A1 Apr. 8, 2021

(30) Foreign Application Priority Data

Aug. 11, 2020 (CN) ..... 20201088147.4

(51) Int. Cl.
*E21B 36/00* (2006.01)

(52) U.S. Cl.
CPC ..... *E21B 36/001* (2013.01)

(58) Field of Classification Search
CPC ..... E21B 36/001
See application file for complete search history.

(56) References Cited

U.S. PATENT DOCUMENTS 2,621,022 A * 12/1952 Bardill ..... E21B 36/001 175/17
3,662,832 A * 5/1972 Keeler ..... E21B 36/003 166/302
4,066,123 A * 1/1978 Skinner ..... E21B 43/12 166/68.5
5,146,987 A * 9/1992 Krieg ..... E21B 33/00 166/302

(Continued)

FOREIGN PATENT DOCUMENTS

CN 111219166 A * 6/2020
CN 111219166 A 6/2020

*Primary Examiner* — Taras P Bemko
*Assistant Examiner* — Jonathan Malikasim

(57) ABSTRACT

The invention discloses a circulating system and a method for continuous downhole cooling of high-temperature drilling fluid. The circulating system includes a cooling water tank, a cooling water injection pump, a plurality of U-shaped pipes, a liquid nitrogen cooling tank, a spiral pipe, a cooling water return pump and a return pipeline. The U-shaped pipe is fixed in an unsealed bond cement gap between outer and inner casings, and two ends are respectively connected with output end of the cooling water injection pump and the spiral pipe. The spiral pipe is disposed in the liquid nitrogen cooling tank; input and output ends of the cooling water return pump are respectively connected with the spiral pipe and the return pipeline; one end of the return pipeline is disposed in the cooling water tank; input end of the cooling water injection pump is connected with the cooling water tank by a pipe.

1 Claim, 2 Drawing Sheets

(56) References Cited

U.S. PATENT DOCUMENTS

| | | | | |
|---|---|---|---|---|
| 8,128,281 | B2 * | 3/2012 | Hadley | E21B 47/047 374/136 |
| 9,677,714 | B2 * | 6/2017 | Wray | F16L 55/1003 |
| 9,845,423 | B2 * | 12/2017 | Frantz | C09K 5/14 |
| 2019/0299128 | A1 * | 10/2019 | Arefi | E21B 21/065 |
| 2021/0216689 | A1 * | 7/2021 | Li | E21B 21/08 |

* cited by examiner

METHOD FOR CONTINUOUS DOWNHOLE COOLING OF HIGH-TEMPERATURE DRILLING FLUID

TECHNICAL FIELD

The present invention relates to a circulating system and a method for continuous downhole cooling of high-temperature drilling fluid, belonging to the technical field of continuous downhole cooling of high-temperature drilling fluid.

DESCRIPTION OF PRIOR ART

With the continuous development of the global economy, people's demand for energy is also increasing. In addition to the exploration and development of oil and gas resources, the exploitation of new energy sources such as geothermal resources, dry hot rocks and combustible ice is also gradually increased. However, the high temperature of drilling fluid has always been a key issue affecting the safety and efficiency of well construction in the development both of oil and gas resources and new energy resources. In the deep and ultra-deep wells of oil and gas drilling, the downhole temperature in some areas can be as high as 180° C. In the drilling of geothermal resources and dry hot rocks, the downhole temperature can be as high as 150° C. to 200° C. Excessively high temperature of the drilling fluid will materially affect its own performance, the service life of downhole operating tools and measuring instruments, and the safety of the wellbore, as well as posing a serious threat to the safety, economic effect and efficiency of well construction.

The existing technologies and equipment for cooling high-temperature drilling fluid mostly adopt ground cooling, that is, reducing the injection temperature of drilling fluid to cool the drilling fluid in the wellbore. However, it is found from the calculation results of relevant theoretical models and the actual application on site that the ground cooling can only reduce the temperature of the drilling fluid in the upper section of the wellbore, while the drilling fluid in the lower section of the wellbore is still at a high temperature. Therefore, the performance of ground cooling is still not ideal when it is used for cooling the high-temperature drilling fluid.

SUMMARY OF THE INVENTION

The invention proposes a circulating system and a method for continuous downhole cooling of high-temperature drilling fluid to overcomes the shortcomings in the prior art.

The technical solution provided by the present invention to the above technical problem is: a circulating system for continuous downhole cooling of high-temperature drilling fluid, including a cooling water tank, a cooling water injection pump, a plurality of U-shaped pipes, a liquid nitrogen cooling tank, a spiral pipe, a cooling water return pump and a return pipeline. The U-shaped pipe is fixed in the unsealed bond cement gap between an outer casing and an inner casing, and two ends are respectively connected with the output end of the cooling water injection pump and the spiral pipe; the spiral pipe is disposed in the liquid nitrogen cooling tank; the input and output ends of the cooling water return pump are respectively connected with the spiral pipe and the return pipeline; one end of the return pipeline is disposed in the cooling water tank; the input end of the cooling water injection pump is connected with the cooling water tank by a pipe.

The volume of the cooling water tank is twice the sum of the volume of all the cooling water insulation pipes to ensure sufficient cooling water injected. The model of the cooling water injection pump is the same as the drilling pump used in drilling.

The further technical solution is that the U-shaped pipe includes a cooling water insulation pipe connected with the output end of the cooling water injection pump and a heat-carrying cooling water pipe connected with the spiral pipe.

The further technical solution is that the cooling water insulation pipe is made of thermal insulation material.

The further technical solution is that a running length of the U-shaped pipe is a length of the inner casing minus the fill-up height of the bond cement, and a diameter is the radius of the outer casing minus the radius of the inner casing.

The further technical solution is that a number of U-shaped pipes is eight, and an angle between two adjacent groups of U-shaped pipes is 45°.

The further technical solution is that the cooling water injection pump and the cooling water return pump are both vane pumps.

A method for continuous downhole cooling of high-temperature drilling fluid with the above circulating system, including the following steps:

step A: obtaining operating parameters, environmental parameters, well structure parameters and thermal parameters of the target well;

step B: placing the U-shaped pipe downward into the unsealed bond cement gap between the outer and inner casings;

step C: opening the cooling water injection pump and the cooling water return pump at the same time to make the cooling water flow from wellhead to downhole, and then returning along the heat-carrying cooling water pipe and continuously absorbing heat from the high-temperature drilling fluid in the annulus under the effect of forced-convection heat transfer and heat conduction, thereby realizing the continuous downhole circulating and cooling of high-temperature drilling fluid in the annulus;

step D: calculating a circulating temperature in the drill string, a circulating temperature in the annulus, and a circulating temperature in the heat-carrying cooling water pipe by the following formulas:

Formula for temperature control in the drill string:

$$\rho_m A_{pipe} c_m \frac{\partial T_{pf}}{\partial t} = -\rho_m A_{pipe} v_{pipe} c_m \frac{\partial T_{pf}}{\partial z} + 2\pi R_{pi} U_{ap}(T_{ann} - T_{pf}).$$

Discrete expression of formula for temperature control in the drill string:

$$B_1(T_{pf})_{i-1}^{n+1} + (A_1 - B_1 + C_1)(T_{pf})_i^{n+1} = A_1(T_{pf})_i^n + C_1 (T_{ann})_i^{n+1}.$$

Formula for temperature control in the annulus:

$$\rho_m A_{ann} c_m \frac{\partial T_{ann}}{\partial t} = \rho_m A_{ann} v_{ann} c_m \frac{\partial T_{ann}}{\partial z} - 2\pi R_{ci} U_{ca}(T_{ann} - T_c) - 2\pi R_{pi} U_{ap}(T_{ann} - T_{pf}).$$

Discrete expression of formula for temperature control in the annulus:

$$B_2(T_{ann})_{i-1}^{n+1}+(A_2-B_2-C_2-D_2)(T_{ann})_i^{n+1}=A_2(T_{ann})_i^n-C_2(T_c)_i^{n+1}-D_2(T_{pf})_i^{n+1}.$$

Formula for temperature control of the heat-carrying cooling water pipe:

$$\rho_w A_c c_w \frac{\partial T_c}{\partial t} = \rho_w A_c v_c c_w \frac{\partial T_c}{\partial z} + 2\pi R_{ci} U_{cf}(T_f - T_c) + 2\pi R_{ci} U_{ca}(T_{ann} - T_c).$$

Discrete expression of formula for temperature control of the heat-carrying cooling water pipe:

$$B_3(T_c)_{i-1}^{n+1} + (A_3 - B_3 + C_3 + D_3)(T_c)_i^{n+1} = A_3(T_c)_i^n + C_3(T_f)_i^{n+1} + D_3(T_{ann})_i^{n+1};$$

$$\frac{1}{U_{ap}} = \frac{1}{h_{pi}} + \frac{R_{pi}}{R_{po}h_{po}} + \frac{R_{pi}}{K_{pipe}}\ln(R_{po}/R_{pi});$$

$$\frac{1}{U_{cf}} = \frac{1}{U_{ca}} = \frac{1}{h_{ci}} + \frac{R_{ci}}{R_{co}h_{co}} + \frac{R_{ci}}{K_c}\ln(R_{co}/R_{ci}).$$

Where, $\rho_m$ and $\rho_w$ are respectively the densities of drilling fluid and cooling water, in kg/m$^3$; $c_m$ and $c_w$ are respectively specific heat capacities of drilling fluid and cooling water, in J/(kg·°C.); $A_{pipe}$, $A_{ann}$ and $A_c$ are respectively cross-sectional areas of the drill string, the annulus and the heat-carrying cooling water pipe, in m$^2$; $v_{pipe}$, $v_{ann}$ and $v_c$ are respectively flow rates in drill string, annulus and heat-carrying cooling water pipe, in m/s; $T_{pf}$, $T_{ann}$ and $T_c$ are respectively fluid circulating temperatures in drill string, annulus and heat-carrying cooling water pipe, in °C.; $R_{pi}$, $R_{po}$, $R_{ci}$ and $R_{co}$ are respectively the inner radius of drill string, the outer radius of drill string, the inner radius of heat-carrying cooling water pipe and the outer radius of heat-carrying cooling water pipe, in m; $h_{pi}$, $h_{po}$, $h_{ci}$ and $h_{co}$ are respectively convective heat transfer coefficient between the fluid in the drill string and the inner wall of the drill string, the fluid in the annulus and the outer wall of the drill string, the fluid in the heat-carrying cooling water pipe and the inner wall of the heat-carrying cooling water pipe, and the fluid in the heat-carrying cooling water pipe and the well wall, in W/(m·°C.); $K_{pipe}$ and $K_c$ are respectively thermal conductivities of drill string and cooling water heating pipe, in W/(m·°C.); $A_1$, $B_1$ and $C_1$ are respectively constants in the formula for temperature control in the drill string; $A_2$, $B_2$, $C_2$ and $D_2$ are respectively constants in the formula for temperature control in the annulus; $A_3$, $B_3$, $C_3$ and $D_3$ are respectively constants in the formula for temperature control of the heat-carrying cooling water pipe;

step E: adjusting a speed of the cooling water injection pump and the cooling water return pump according to the circulating temperature respectively in the drill string, the annulus and the heat-carrying cooling water pipe obtained above;

step F: the cooling water carrying heat flowing into the spiral pipe, and being cooled in the liquid nitrogen cooling tank; and step G: the cooled cooling water being pumped into the return pipe by the cooling water return pump, and being re-injected into the cooling water tank for continued circulating and cooling at the next stage.

The present invention has the following beneficial effects:

(1) the present invention makes full use of the unsealed bond cement gap between the two casings, and adopts the method of injecting cooling water into downhole to directly cool down the high-temperature drilling fluid in the circulating process continuously;

(2) the present invention makes full use of the small gap between the two casings to directly reinforce the cooling water insulation pipe and the heat-carrying cooling water pipe the run into the well without installing additional reinforcement equipment, which is convenient and reliable for run-in and installation; and (3) the present invention adopts a closed-loop circulating method to cool down the heat-carrying cooling water returned to the ground and then pump it into the cooling water tank again for continued circulating and cooling at the next stage, so as to make full utilization of previous water resources.

DETAILED DESCRIPTION OF THE PREFERRED EMBODIMENTS

The present invention will be further described with the following embodiments and figures.

Figure 1:
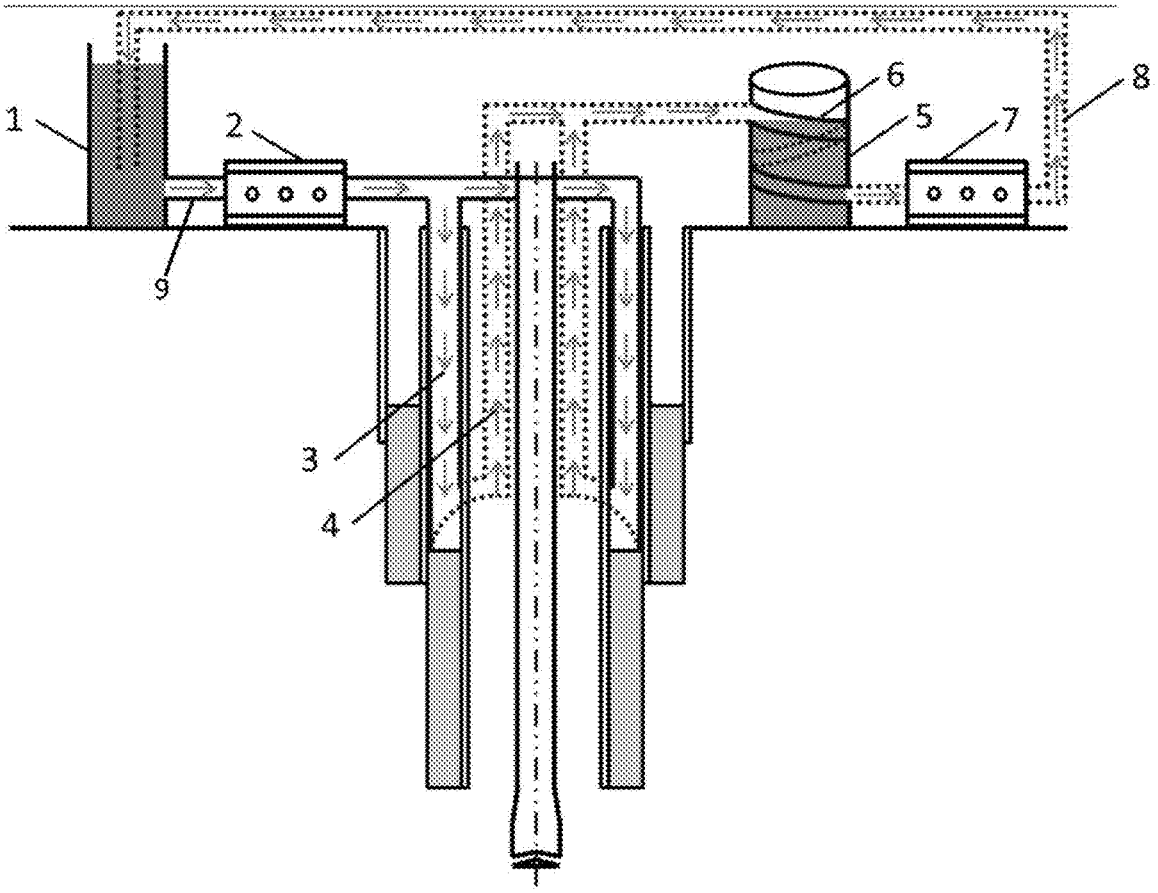
FIG. 1 is a schematic diagram of system composition of the present invention.
Figure 2:
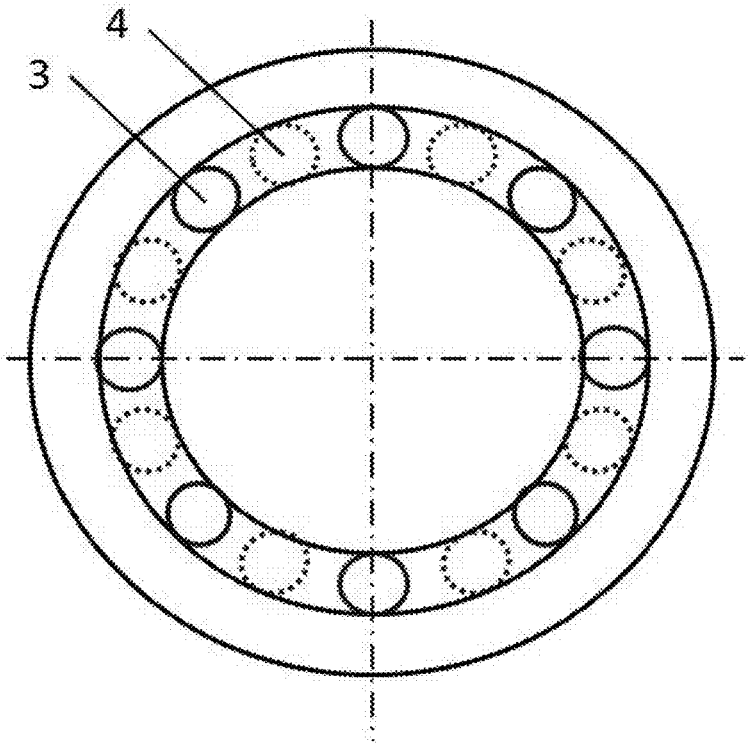
FIG. 2 is a top view of the wellhead of the present invention.

As shown in FIG. 1 and FIG. 2, a circulating system for continuous downhole cooling of high-temperature drilling fluid is provided in the present invention, including a cooling water tank 1, a cooling water injection pump 2, eight U-shaped pipes, a liquid nitrogen cooling tank 5, a spiral pipe 6, a cooling water return pump 7 and a return pipeline 8. The eight U-shaped pipes are respectively fixed in the unsealed bond cement gap between the outer and inner casings. The angle between two adjacent groups of U-shaped pipes is 45° to avoid the heat exchange, which will affect the overall cooling effect, between the two groups of U-shaped pipes, and two ends of the U-shaped pipe are respectively connected with the output end of the cooling water injection pump 2 and the spiral pipe 6. The spiral pipe 6 is disposed in the liquid nitrogen cooling tank 5. The spiral pipe 6 increases the flow path of heat-carrying cooling water in the liquid nitrogen cooling tank 5, and prolongs the heat exchange between the heat-carrying cooling water and the external liquid nitrogen. There is full of liquid nitrogen outside of the pipe, so it is easy to cool the heat-carrying cooling water due to the feature that liquid nitrogen is easy to absorb heat and sublimate.

The input end and the output end of the cooling water return pump 7 are respectively connected with the spiral pipe 6 and the return pipeline 8. One end of the return pipeline 8 is disposed in the cooling water tank 1. The input end of the cooling water injection pump 2 is connected with the cooling water tank 1 by a pipe 9.

The process and principles of the present invention for continuous downhole cooling of the high-temperature drilling fluid are described as follows:

(1) In actual cooling process, the cooling water injection pump continuously pumps the cooling water into the cooling water insulation pipe from the cooling water tank.

(2) Due to the insulation effect of the cooling water insulation pipe, the cooling water will not exchange heat with the high-temperature drilling fluid in the annulus when it flows from the wellhead to the bottom of the well. The temperature of the cooling water is always maintained at the temperature when it enters the inlet. In the process of returning along the heat-carrying cooling water pipe, the cooling water will continuously absorb heat from the high-temperature drilling fluid in the annulus through convective heat exchange and heat conduction, thereby achieving continuous downhole cooling of the high-temperature drilling fluid in the annulus. After the drilling fluid in the annulus is cooled by the cooling water, the heat transferred to the drilling fluid in the drill string is reduced, thus further realizing continuous downhole cooling of the high-temperature drilling fluid in the drill string.

After the drilling fluid in the drill string is cooled, the temperature of the drilling fluid flowing into the annulus will also decrease, that is to say, the high-temperature drilling fluid in the annulus which is not in contact with the heat-carrying cooling water pipe will be continuously cooled.

(3) After being heated, the cooling water will return to the liquid nitrogen cooling tank on the ground. After the carrying-heat cooling water flows into the liquid nitrogen cooling tank, it will flow along the spiral pipe in the tank to the liquid outlet. When the heat-carrying cooling water flows, the liquid nitrogen outside the pipe will be heated and sublimated, so as to cool the heat-carrying cooling water in the spiral pipe.

(4) The cooled cooling water will be pumped into the return pipe by the cooling water return pump, and re-injected into the cooling water tank for continued circulating and cooling at the next stage.

As shown in FIG. 1, the U-shaped pipe in this embodiment includes the cooling water insulation pipe 3 connected with the output end of the cooling water injection pump 2 and the heat-carrying cooling water pipe 4 connected with the spiral pipe 6. The cooling water insulation pipe 3 is made of thermal insulation material to ensure that the cooling water will not be heated by the high-temperature drilling fluid in the annulus when it flows from the wellhead to the bottom of the well. The heat-carrying cooling water pipe 4 is made of the material as the same as that of the casing, which enhances the heat exchange between the cooling water and the high-temperature drilling fluid in the annulus during the upward return process. The running length of the U-shaped pipe is the length of the inner casing minus the fill-up height of the bond cement and the diameter is the radius of the outer casing minus the radius of the inner casing.

The cooling water injection pump 2 and cooling water return pump 7 in this embodiment are specifically both vane pumps.

The method for continuous downhole cooling of high-temperature drilling fluid using above embodiments, including the following steps:

Step A: obtaining operating parameters, environmental parameters, well structure parameters and thermal parameters of the target well.

Step B: placing the U-shaped pipe downward into the unsealed bond cement gap between the outer and inner casings.

Step C: opening the cooling water injection pump 2 and the cooling water return pump 7 at the same time to make the cooling water injection pump 2 continuously pump the cooling water in the cooling water tank 1 into the cooling water insulation pipe 3 and to make the cooling water flow from wellhead to downhole, and then returning along the heat-carrying cooling water pipe 4 and continuously absorbing heat from the high-temperature drilling fluid in the annulus under the effect of forced-convection heat transfer and heat conduction, thereby realizing the continuous downhole circulating and cooling of high-temperature drilling fluid in the annulus.

Step D: calculating the circulating temperature in the drill string, the circulating temperature in the annulus, and the circulating temperature in the heat-carrying cooling water pipe by the following formulas.

Formula for temperature control in the drill string:

$$\rho_m A_{pipe} c_m \frac{\partial T_{pf}}{\partial t} = -\rho_m A_{pipe} v_{pipe} c_m \frac{\partial T_{pf}}{\partial z} + 2\pi R_{pi} U_{ap}(T_{ann} - T_{pf}).$$

Discrete expression of formula for temperature control in the drill string:

$$B_1(T_{pf})_{i-1}^{n+1} + (A_1 - B_1 + C_1)(T_{pf})_i^{n+1} = A_1(T_{pf})_i^n = C_1 (T_{ann})_i^{n+1}.$$

Formula for temperature control in the annulus:

$$\rho_m A_{ann} c_m \frac{\partial T_{ann}}{\partial t} = \rho_m A_{ann} v_{ann} c_m \frac{\partial T_{ann}}{\partial z} - 2\pi R_{ci} U_{ca}(T_{ann} - T_c) - 2\pi R_{pi} U_{ap}(T_{ann} - T_{pf}).$$

Discrete expression of formula for temperature control in the annulus:

$$B_2(T_{ann})_{i-1}^{n+1} + (A_2 - B_2 - C_2 - D_2)(T_{ann})_i^{n+1} = A_2(T_{ann})_i^n - C_2(T_c)_i^{n+1} - D_2(T_{pf})_i^{n+1}.$$

Formula for temperature control of the heat-carrying cooling water pipe:

$$\rho_w A_c c_w \frac{\partial T_c}{\partial t} = \rho_w A_c v_c c_w \frac{\partial T_c}{\partial z} + 2\pi R_{ci} U_{cf}(T_f - T_c) + 2\pi R_{ci} U_{ca}(T_{ann} - T_c).$$

Discrete expression of formula for temperature control of the heat-carrying cooling water pipe:

$$B_3(T_c)_{i-1}^{n+1} + (A_3 - B_3 + C_3 + D_3)(T_c)_i^{n+1} = A_3(T_c)_i^n + C_3(T_f)_i^{n+1} + D_3(T_{ann})_i^{n+1};$$

$$\frac{1}{U_{ap}} = \frac{1}{h_{pi}} + \frac{R_{pi}}{R_{po} h_{po}} + \frac{R_{pi}}{K_{pipe}} \ln(R_{po}/R_{pi});$$

$$\frac{1}{U_{cf}} = \frac{1}{U_{ca}} = \frac{1}{h_{ci}} + \frac{R_{ci}}{R_{co} h_{co}} + \frac{R_{ci}}{K_c} \ln(R_{co}/R_{ci}).$$

Where, $\rho_m$ and $\rho_w$ are respectively densities of drilling fluid and cooling water, in kg/m$^3$; $c_m$ and $c_w$ are respectively specific heat capacities of drilling fluid and cooling water, in J/(kg·°C.); $A_{pipe}$, $A_{ann}$ and $A_c$ are respectively cross-sectional areas of drill string, annulus and heat-carrying cooling water pipe, in m$^2$; $v_{pipe}$, $v_{ann}$ and $v_c$ are respectively flow rates in drill string, annulus and heat-carrying cooling water pipe, in m/s; $T_{pf}$, $T_{ann}$ and $T_c$ are respectively fluid circulating temperatures s in drill string, annulus and heat-carrying cooling water pipe, in °C.; $R_{pi}$, $R_{po}$, $R_{ci}$ and $R_{co}$ are respectively the inner radius of drill string, the outer radius of drill string, the inner radius of heat-carrying cooling water pipe and the outer radius of heat-carrying cooling water pipe, in m; $h_{pi}$, $h_{po}$, $h_{ci}$ and $h_{co}$ are respectively the convective heat transfer coefficients between the fluid in the drill string and the inner wall of the drill string, the fluid in the annulus and the outer wall of the drill string, the fluid in the heat-carrying cooling water pipe and the inner wall of the heat-carrying cooling water pipe, and the fluid in the heat-carrying cooling water pipe and the well wall, in W/(m·°C.); $K_{pipe}$ and $K_c$ are respectively thermal conductivities of drill string and cooling water heating pipe, in W/(m·°C.); $A_1$, $B_1$ and $C_1$ are respectively constants in the formula for temperature control in the drill string; $A_2$, $B_2$, $C_2$ and $D_2$ are respectively constants in the formula for temperature control in the annulus; $A_3$, $B_3$, $C_3$ and $D_3$ are respectively constants in the formula for temperature control of the heat-carrying cooling water pipe; t represents a circulating time of the drilling fluid, in s; z represents a length of the drill string or a length of the annulus or a length of the heat-carrying cooling water pipe, in m; $U_{ap}$ represents a total heat transfer coefficient between the drilling fluid in the annulus and the drilling fluid in the drill string, in W/(m·°C.); $U_{ca}$ represents a total heat transfer coefficient between the drilling fluid in the heat-carrying cooling water pipe and the drilling fluid in the annulus, in W/(m·°C.); and $U_{cf}$ represents a total heat transfer coefficient between the outer casing and a formation, in W/(m·°C.).

Step E: adjusting a speed of the cooling water injection pump 2 and the cooling water return pump 7 according to the circulating temperature respectively in the drill string, the annulus and the heat-carrying cooling water pipe obtained above.

Step F: the cooling water carrying heat flowing into the spiral pipe 6, and being cooled in the liquid nitrogen cooling tank 5.

Step G: the cooled cooling water being pumped into the return pipe 8 by the cooling water return pump 7, and being re-injected into the cooling water tank 1 for continued circulating and cooling at the next stage.

Figure 3:
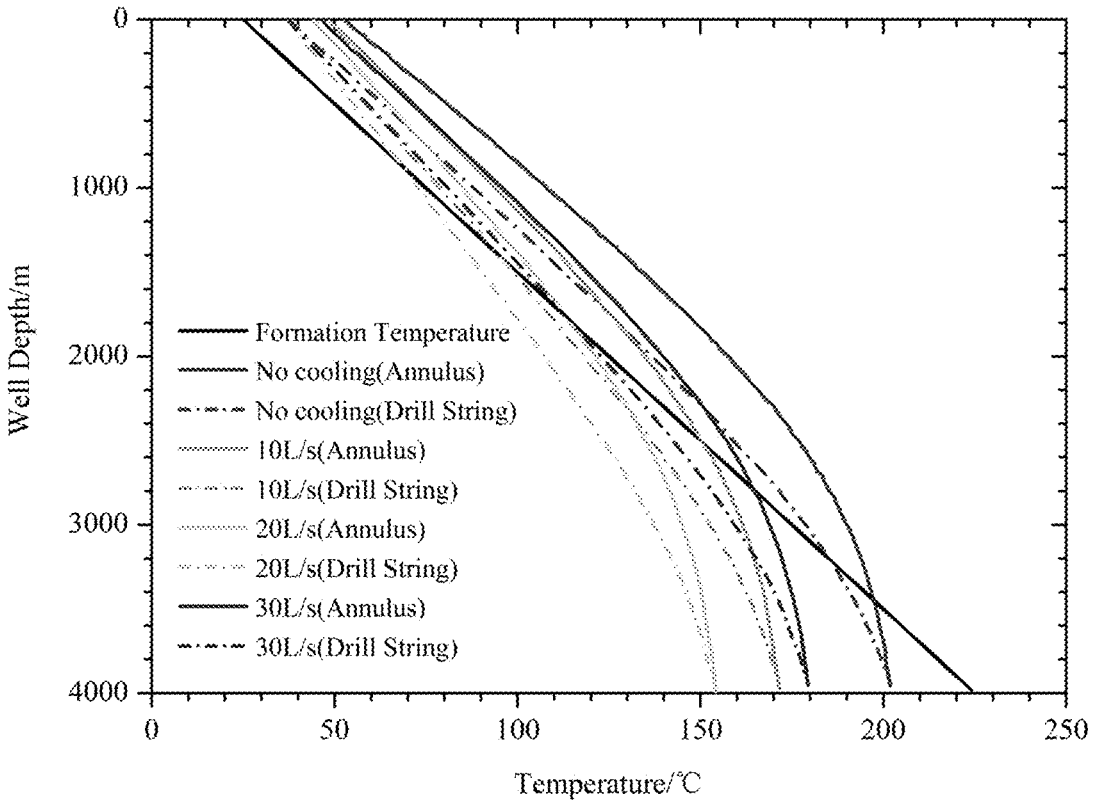
FIG. 3 is a calculation diagram of the embodiment.

In the above embodiment, the displacement of the drilling pump is 40 L/s, and the displacements of the cooling water injection pump are 10 L/s, 20 L/s, and 30 L/s, respectively. The calculation results are shown in FIG. 3. Learned from the figure, it can be found that when the displacement of the cooling water injection pump is 20 L/s (½ of the drilling pump's displacement), the relative flow of the cooling water in the heat-carrying pipe and the high-temperature drilling fluid in the annulus is more uniform, and the cooling effect is the best.

The above are not intended to limit the present invention in any form. Although the present invention has been disclosed as above with embodiments, it is not intended to limit the present invention. Those skilled in the art, within the scope of the technical solution of the present invention, can use the disclosed technical content to make a few changes or modify the equivalent embodiment with equivalent changes. Within the scope of the technical solution of the present invention, any simple modification, equivalent change and modification made to the above embodiments according to the technical essence of the present invention are still regarded as a part of the technical solution of the present invention.

What is claimed is:

1. A method for continuous downhole cooling of high-temperature drilling fluid with a circulating system comprising a cooling water tank, a cooling water injection pump, a plurality of U-shaped pipes, a liquid nitrogen cooling tank, a spiral pipe, a cooling water return pump and a return pipeline, wherein the U-shaped pipes are fixed in an unsealed bond cement gap between an outer casing and an inner casing, and two ends of each of the U-shaped pipes are respectively connected with an output end of the cooling water injection pump and the spiral pipe; the spiral pipe is disposed in the liquid nitrogen cooling tank; an input end and an output end of the cooling water return pump are respectively connected with the spiral pipe and the return pipeline; one end of the return pipeline is disposed in the cooling water tank; an input end of the cooling water injection pump is connected with the cooling water tank by a pipe, the method comprising the following steps:

step A: obtaining operating parameters, environmental parameters, well structure parameters and thermal parameters of a target well;

step B: placing the plurality of U-shaped pipes downward into the unsealed bond cement gap between the outer casing and the inner casing;

step C: opening the cooling water injection pump and the cooling water return pump at the same time to make a cooling water flow from a wellhead to a downhole location, and then returning along a heat-carrying cooling water pipe of each one of the U-shaped pipes and continuously absorbing heat from the high-temperature drilling fluid in an annulus under effect of forced-convection heat transfer and heat conduction, thereby realizing the continuous downhole circulating and cooling of high-temperature drilling fluid in the annulus;

step D: calculating a circulating temperature in a drill string, a circulating temperature in the annulus, and a circulating temperature in the heat-carrying cooling water pipe by the following formulas:

formula for temperature control in the drill string:

$$\rho_m A_{pipe} c_m \frac{\partial T_{pf}}{\partial t} = -\rho_m A_{pipe} v_{pipe} c_m \frac{\partial T_{pf}}{\partial z} + 2\pi R_{pi} U_{ap}(T_{ann} - T_{pf});$$

discrete expression of formula for temperature control in the drill string:

$$B_1(T_{pf})_{i-1}^{n+1} + (A_1 - B_1 + C_1)(T_{pf})_i^{n+1} = A_1(T_{pf})_i^n + C_1 (T_{ann})_i^{n+1}.$$

formula for temperature control in the annulus:

$$\rho_m A_{ann} c_m \frac{\partial T_{ann}}{\partial t} = \rho_m A_{ann} v_{ann} c_m \frac{\partial T_{ann}}{\partial z} - 2\pi R_{ci} U_{ca}(T_{ann} - T_c) - 2\pi R_{pi} U_{ap}(T_{ann} - T_{pf});$$

discrete expression of formula for temperature control in the annulus:

$$B_2(T_{ann})_{i-1}^{n+1} + (A_2 - B_2 - C_2 - D_2)(T_{ann})_i^{n+1} = A_2(T_{ann})_i^n - C_2(T_c)_i^{n+1} - D_2(T_{pf})_i^{n+1}.$$

formula for temperature control of the heat-carrying cooling water pipe:

$$\rho_w A_c c_w \frac{\partial T_c}{\partial t} = \rho_w A_c v_c c_w \frac{\partial T_c}{\partial z} + 2\pi R_{ci} U_{cf}(T_f - T_c) + 2\pi R_{ci} U_{ca}(T_{ann} - T_c);$$

discrete expression of formula for temperature control of the heat-carrying cooling water pipe:

$$B_3(T_c)_{i-1}^{n+1} + (A_3 - B_3 + C_3 + D_3)(T_c)_i^{n+1} =$$

-continued $$A_3(T_c)_i^n + C_3(T_f)_i^{n+1} + D_3(T_{ann})_i^{n+1};$$

$$\frac{1}{U_{ap}} = \frac{1}{h_{pi}} + \frac{R_{pi}}{R_{po}h_{po}} + \frac{R_{pi}}{K_{pipe}}\ln(R_{po}/R_{pi});$$

$$\frac{1}{U_{cf}} = \frac{1}{U_{ca}} = \frac{1}{h_{ci}} + \frac{R_{ci}}{R_{co}h_{co}} + \frac{R_{ci}}{K_c}\ln(R_{co}/R_{ci});$$

where, $\rho_m$ and $\rho_w$ are respectively densities of the drilling fluid and the cooling water, in kg/m$^3$; $c_m$ and $c_w$ are respectively specific heat capacities of drilling fluid and cooling water, in J/(kg·°C.); $A_{pipe}$, $A_{ann}$ and $A_c$ are respectively cross-sectional areas of the drill string, the annulus and the heat-carrying cooling water pipe, in m$^2$; $v_{pipe}$, $v_{ann}$ and $v_c$ are respectively flow rates in the drill string, the annulus and the heat-carrying cooling water pipe, in m/s; $T_{pf}$, $T_{ann}$ and $T_c$ are respectively fluid circulating temperatures in the drill string, the annulus and the heat-carrying cooling water pipe, in °C.; $R_{pi}$, $R_{po}$, $R_{ci}$ and $R_{co}$ are respectively the inner radius of drill string, the outer radius of drill string, the inner radius of heat-carrying cooling water pipe and the outer radius of heat-carrying cooling water pipe, in m; $h_{pi}$, $h_{po}$, $h_{ci}$ and $h_{co}$ are respectively convective heat transfer coefficients between the drilling fluid in the drill string and an inner wall of the drill string, the fluid in the annulus and an outer wall of the drill string, the fluid in the heat-carrying cooling water pipe and the inner wall of the heat-carrying cooling water pipe, and the fluid in the heat-carrying cooling water pipe and the well wall, in W/(m·°C.); $K_{pipe}$ and $K_c$ are respectively thermal conductivity of the drill string and the cooling water heating pipe, in W/(m·°C.); $A_1$, $B_1$ and $C_1$ are respectively constants in the formula for temperature control in the drill string; $A_2$, $B_2$, $C_2$ and $D_2$ are respectively constants in the formula for temperature control in the annulus; $A_3$, $B_3$, $C_3$ and $D_3$ are respectively constants in the formula for temperature control of the heat-carrying cooling water pipe; t represents a circulating time of the drilling fluid, in s; z represents a length of the drill string or a length of the annulus or a length of the heat-carrying cooling water pipe, in m; $U_{ap}$ represents a total heat transfer coefficient between the drilling fluid in the annulus and the drilling fluid in the drill string, in W/(m·°C.); $U_{ca}$ represents a total heat transfer coefficient between the drilling fluid in the heat-carrying cooling water pipe and the drilling fluid in the annulus, in W/(m·°C.); and $U_{cf}$ represents a total heat transfer coefficient between the outer casing and a formation, in W/(m·°C.);

step E: adjusting a speed of the cooling water injection pump and the cooling water return pump according to the circulating temperature respectively in the drill string, the annulus and the heat-carrying cooling water pipe obtained above;

step F: the cooling water carrying heat flowing into the spiral pipe, and being cooled in the liquid nitrogen cooling tank; and step G: the cooled cooling water being pumped into the return pipe by the cooling water return pump, and being re-injected into the cooling water tank for continued circulating and cooling at a next stage.

* * * * *